United States Patent [19]

Dumont

[11] Patent Number: 4,486,171

[45] Date of Patent: Dec. 4, 1984

[54] DISPOSABLE GAS LIGHTER AND DEVICE FOR FILLING SAME

[75] Inventor: Bernard Dumont, Les Avenieres, France

[73] Assignee: Feudor S.A., Rhone, France

[21] Appl. No.: 462,984

[22] Filed: Feb. 1, 1983

Related U.S. Application Data

[62] Division of Ser. No. 298,739, Sep. 2, 1981, Pat. No. 4,448,226.

[30] Foreign Application Priority Data

Sep. 5, 1980 [FR] France ..... 80 19587

[51] Int. Cl.[3] ..... F23Q 2/16

[52] U.S. Cl. ..... 431/344; 431/254; 251/325

[58] Field of Search ..... 431/344, 130, 131, 142, 431/143, 150, 254; 251/118, 319, 325, 330, 339; 222/3, 402.16; 141/3, 20

[56] References Cited

U.S. PATENT DOCUMENTS

| | | | |
|---|---|---|---|
| 2,802,490 | 8/1957 | Ward | 141/20 |
| 3,180,536 | 4/1965 | Meshberg | 251/353 |
| 3,301,019 | 1/1967 | Meylan | 431/131 |
| 3,499,719 | 3/1970 | Kitabayashi | 431/344 |
| 4,072,162 | 2/1978 | Bellehache et al. | 137/71 |

*Primary Examiner*—Carroll B. Dority, Jr.
*Attorney, Agent, or Firm*—Karl F. Ross

[57] ABSTRACT

A disposable gas lighter is formed with a liquid-fuel reservoir having a well molded into the housing at an upper portion thereof and provided with a plug member having a plurality of positions including a first position in which a passage is provided into the reservoir, a second position in which the well and the flow can be completely closed off and a third position in which the member is completely clear of the well to enable the well to serve to accommodate a valve system and a flow control device for the lighter. The axially displaceable member, having the aforementioned three positions, may be molded as part of the lighter housing and the well and can be broken loose when it is necessary to fill the reservoir.

6 Claims, 5 Drawing Figures

DISPOSABLE GAS LIGHTER AND DEVICE FOR FILLING SAME

CROSS REFERENCE TO RELATED APPLICATIONS

This application is a division of Ser. No. 298,739 filed Sept. 2, 1981 (now U.S. Pat. No. 4,448,226 issued May 15, 1984), which was related to the commonly owned copending application Ser. No. 298,725 also filed Sept. 2, 1981.

FIELD OF THE INVENTION

My present invention relates to a disposable gas lighter of the wickless type and to a device for facilitating the filling of the lighter. More particularly, the invention relates to a lighter of the type which comprises a reservoir adapted to be filled with a liquid hydrocarbon, especially butane or mixtures of butane and other hydrocarbons, from which a gas stream is adapted to be released by manipulation of a valve member seated in a well in the lighter body and ignited by a spark mechanically or electromechanically struck at the mouth of the burner portion of this valve.

BACKGROUND OF THE INVENTION

Disposable lighters generally comprise a molded synthetic resin reservoir or lighter body which is formed, at an upper portion thereof, with a well in which a valve system is seated and through which fuel can be released in the form of a controlled stream for ignition by a striking mechanism or the like at the top of the lighter to provide the flame.

Such lighters can be of the wickless type, i.e. the fuel in the form of gas or liquid can be passed through a filter, membrane or other flow control device, e.g. as described in U.S. Pat. Nos. 4,060,202 granted Nov. 29, 1977, 4,101,262 granted July 18, 1978 and 4,224,020 granted Sept. 23, 1980.

Within the well provided in the lighter body, valve seat is formed, generally downstream of the aforementioned flow control device, for cooperation with the axially shiftable valve body which can be manipulated by a lever adapted to be engaged by the thumb of the user.

Thus, when the valve is opened, the fuel in a gaseous form emerges as a stream and is ignited by a striker mechanism mounted on the lighter body and which also can be actuated by the thumb of the user. The height of the flame can be controlled at the time of manufacture by the flow-control filter in accordance with the aforementioned application or patents. This prevents danger to the user from excessively high flames.

The well in the lighter is generally formed by molding unitarily with the major portion of the lighter body and reservoir. The body of the lighter and the reservoir is closed by a bottom which can be ultrasonically, thermally or solvent welded to the lighter body.

Heretofore such lighters have been filled with gaseous or liquid hydrocarbon fuel through this bottom which was provided with a filling port, the latter being closed by a nail-like member upon conclusion of the filling operation. As a result, the bottom was of complex shape, difficult to mold and delicate to weld onto the body because of the complex shape. Frequently, the bottom had to be made from a material different from the material forming the remainder of the body because of the necessity of providing the filling port or mechanism, and disposal of the lighter, upon emptying, was complicated by the presence of the nail or other closure members.

OBJECTS OF THE INVENTION

It is the principal object of the present invention to provide an improved lighter or lighter-body structure which can facilitate filling without the disadvantages enumerated above.

It is also an object of my invention to provide an improved device facilitating the filling of a lighter of the type described.

SUMMARY OF THE INVENTION

These objects and others which will become apparent hereinafter are attained, in accordance with the invention, by forming the valve-receiving well in the body of the lighter with a cylindrical portion and disposing within this cylindrical portion a three-position obturator which has three portions in axially spaced relationship of different cross sectional shape, a first such portion in the first position of the obturator defining a passage with the cylindrical portion of the well through which the fuel can be introduced into the reservoir through this well, a second portion fitting snugly in this cylindrical portion and defining a seal therewith blocking escape of fuel from the reservoir in a second position of the obturator, and a third portion affording all-around clearance between the obturator and the cylindrical portion and which, upon axial displacement of the obturator into a third position, permits free flow from the reservoir to the valve system seated in the well.

Thus the well can serve simultaneously as part of the means for filling the reservoir with fuel and as a housing for the valve system through which the fuel stream emerges, the valve system being preferably constituted in accordance with one of the valve systems disclosed in the aforementioned application of U.S. patents.

With the arrangement of the invention, fuel-introduction and welding operations on the bottom of the lighter are no longer necessary and the bottom can be made of a simpler shape to facilitate ultrasonic welding and to improve the balance of the lighter. Furthermore the body and the bottom can be made of the same material and they need not contain any foreign matter so that, especially when composed of synthetic resin, they can be reclaimed.

According to a feature of the invention the first section of the obturator and the second section of the obturator have the same cross sectional outline shape although the first section is provided with a groove and the second section is free from any such discontinuity. The first and second sections can thus be cylindrical and of essentially the same outer diameter as the inner diameter of the aforementioned cylindrical portion of the well, aside from the groove in the first section. The third section can be a portion of the obturator of reduced cross section.

According to another feature of the invention, the obturator is molded in a single piece with the lighter body and well and can be connected with the lower or inner edge of the well by frangible means, e.g. lugs, a web of material or both, so that the obturator can be broken loose by axial and/or angular displacement relative to the body and shifted into its three positions in succession.

The obturator can be pushed fully into the reservoir so that it falls freely therein and gives rise to a bell-like sound capable of serving as an indication of the presence of liquid fuel therein, or can be retained by the valve assembly upon its insertion into the well if this sound its undesired. In the latter case, the valve assembly holds the obturator in its third position while, in the former case, the third position is merely transitory between the second position and a position in which the obturator falls freely into the reservoir.

It has been found to be advantageous to facilitate engagement of the valve assembly with the obturator to provide the obturator with a corrugated extremity extending axially from the upper free end of the third portion and capable of lodging in the valve member. This portion of the obturator can also be gripped by the filling nozzle when the obturator is to be axially displaced and for detachment of the obturator from the body.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
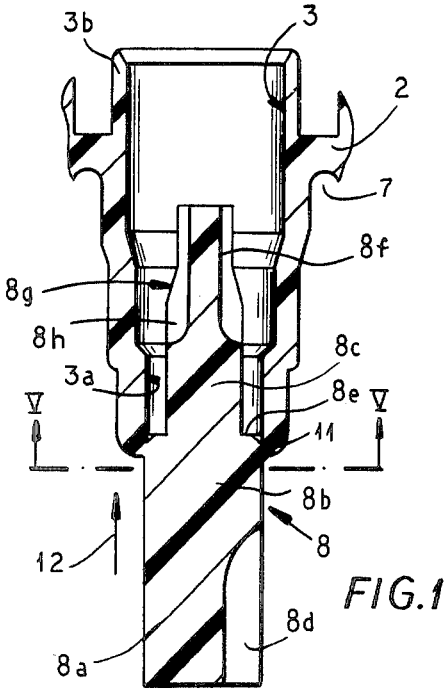
FIG. 1 is an axial section through the well of a lighter body molded unitarily with an obturator according to the invention.

In the drawing I have shown a part of the upper portion 2 of the wall of a lighter body adapted to receive liquid butane or a mixture of butane with other hydrocarbons as a lighter fuel, for a lighter which operates otherwise in the manner described in the aforementioned application and patents.

The wall 2 of the lighter body is formed unitarily with a well 3 which is designed to form a housing for the lighter valve and to be surmounted by the lighter head which can include the mechanism for actuating this valve and a striker mechanism for striking a spark to ignite a flow of fuel from a burner aperture of the well. The valve system can include a filter and membrane arrangement as described in the aforementioned application for limiting the height of the flame.

The largest portion of the well 3 projects inwardly toward the reservoir 7 and has a lower cylindrical portion 3*a* adapted to cooperate with an obturator 8 having three axially separated sections, 8*a*, 8*b* and 8*c*, respectively forming first, second and third portions or sections.

Figure 5:
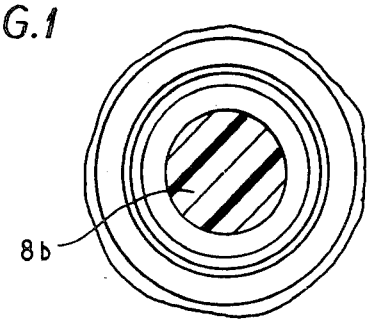
FIG. 5 is a partial section along the line V—V of FIG. 1.
Figure 3:
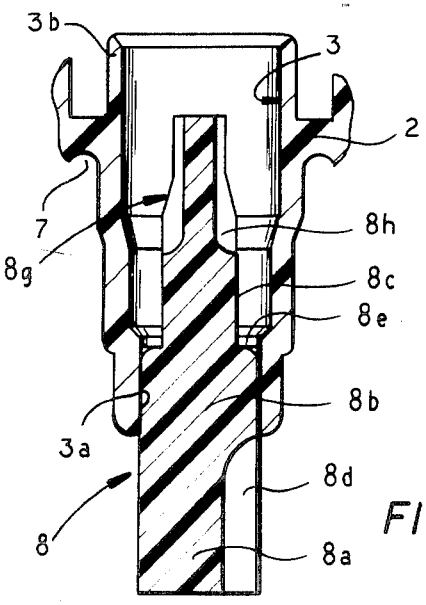
FIG. 3 is a view similar to FIG. 2 showing the obturator in its second position.

As can be seen from FIGS. 1 and 5 the upper edge of section 8*b* can be affixed to the lower lip of the cylindrical portion 3*a*. Hence the obturator 8 and the well can be molded unitarily at the time the lighter body is formed.

Sections 8*a* and 8*b* have generally the same cross sections and diameter, corresponding to the cross section of cylindrical portion 3*a* and the diameter thereof and are preferably cylindrical, the section 8*a* being formed with an aixally extending groove 8*d*.

Figure 2:
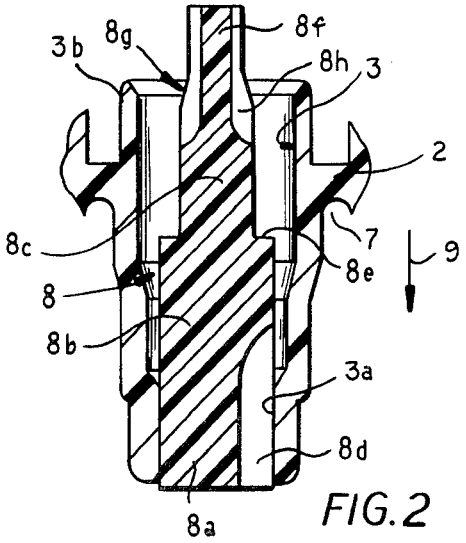
FIG. 2 is an axial cross sectional view of the well showing an obturator separated therefrom or independently formed therefrom, in its first position for filling the reservoir.

For filling the lighter, the free end or top 8*g* of the obturator 8, which is corrugated to have ribs 8*f* and grooves 8*h*, can be engaged by the nozzle of the filling device whereupon the obturator is displaced to break it loose and allow retraction of the obturator into the first position shown in FIG. 2 in which the first section 8*a* is within the cylindrical portion 3*a* and a passage is defined by the groove 8*d* to permit gas to flow into the reservoir. The obturator is then shifted in the direction of arrow 9 axially so that the second portion 8*b* is recieved in the cylindrical portion 3*a* and the interior of the reservoir sealed to prevent escape of fume.

Between the position shown in FIGS. 1 and 2, the obturator is displaced in the direction of arrow 12 towards the upper end 3*b* of the well.

Figure 4:
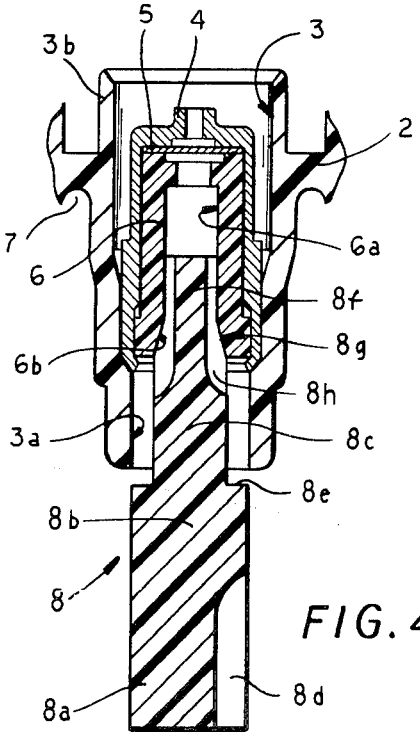
FIG. 4 is another view similar to FIG. 2 showing the obturator in third position and engaged by a valve assembly.

When the valve assembly 4 through 6 is then inserted in the direction of arrow 9, the obturator 8 is displaced downwardly against the resistance of the sealing force with which the section 8*b* is hugged by the wall portion 3*a* to provide all-around clearance between the third portion 8*c* and portion 3*a* (see FIG. 4).

The portion of the valve assembly shown in the drawing comprises a cylindrical sleeve or support member 6 having a cavity whose frustoconical lower portion 6*b* and cylindrical upper portion 6*a* grip the end 8*g* of the obturator in a wedgelike manner.

Prior to insertion of the valve assembly, a flame-height-controlling filter 5 is clamped between the support sleeve 6 and an outer member 4 having an upper cylindrical boss defining a valve seat. The cooperation of the valve member with this valve seat is described in the aforementioned application and patents. Gas flow from the reservoir to the seat is ensured by the grooves 8*h* which form part of the corrugations previously mentioned.

I claim:

1. In a lighter having a lighter body forming a reservoir, a well adapted to receive a filling valve assembly for the controlled outflow of fuel from said reservoir, the improvement which comprises in combination with said valve assembly of:

an annular wall portion formed on said well in said body; and an axially shiftable obturator having axially spaced first, second and third sections, said first section being formed with a passage enabling filling of said reservoir through said well with a liquid fuel upon the positioning of said obturator with said first section in said wall portion in a first position of said obturator and prior to fitting of said valve assembly in said well, said second section of said obturator having a cross section corresponding to that of said annular portion for blocking fuel flow from said well upon positioning of said second section in said annular portion in a second position of said obturator whereby said valve assembly can be inserted in said well without escape of fuel, said third section being of a cross section less than that of said annular portion whereby disposition of said obturator with said third section in said annular portion allows permanent free passage of fuel to said valve assembly after it has been inserted in said well.

2. The improvement defined in claim 1 wherein said obturator is unitary with said body and is connected with said well via frangible means.

3. The improvement defined in claim 2 wherein said obturator is connected with said well at an edge of said second section and at an innermost lip of said well.

4. The improvement defined in claim 1 wherein said obturator is formed with a free end beyond said third section which is lodged in said valve assembly and define fuel-flow passages therewith.

5. The improvement defined in claim 2 wherein said obturator is formed with a free end beyond said third section which is lodged in said valve assembly and define fuel-flow passages therewith.

6. The improvement defined in claim 3 wherein said obturator is formed with a free end beyond said third section which is lodged in said valve assembly and define fuel-flow passages therewith.

* * * * *